US007882985B2

(12) United States Patent
Ophardt

(10) Patent No.: US 7,882,985 B2
(45) Date of Patent: Feb. 8, 2011

(54) FLUID DISPENSER WITH SANITARY NOZZLE

(75) Inventor: Heiner Ophardt, Vineland (CA)

(73) Assignee: Gotohti.com Inc., Beamsville, Ontario (CA)

( * ) Notice: Subject to any disclaimer, the term of this patent is extended or adjusted under 35 U.S.C. 154(b) by 1016 days.

(21) Appl. No.: 11/650,965

(22) Filed: Jan. 9, 2007

(65) Prior Publication Data

US 2007/0158363 A1 Jul. 12, 2007

(30) Foreign Application Priority Data

Jan. 12, 2006 (CA) ..... 2532641

(51) Int. Cl.
*B67D 7/06* (2010.01)

(52) U.S. Cl. ..... 222/180; 222/181.1; 222/181.3; 222/182; 222/183; 222/321.8; 222/325

(58) Field of Classification Search ..... 222/181.2, 222/173, 181.3, 183, 185.1, 182, 372, 321.8, 222/321.7, 325, 321.9, 341, 180, 181.1
See application file for complete search history.

(56) References Cited

U.S. PATENT DOCUMENTS

| | | | | |
|---|---|---|---|---|
| 3,032,081 | A * | 5/1962 | La Cotta | 141/362 |
| 3,100,065 | A * | 8/1963 | Gross | 222/180 |
| 4,214,676 | A * | 7/1980 | Cassia | 222/83.5 |
| 5,165,577 | A | 11/1992 | Ophardt | |
| 5,927,548 | A * | 7/1999 | Villaveces | 222/82 |
| 6,209,184 | B1 * | 4/2001 | Copeland et al. | 29/428 |
| 7,367,477 | B2 * | 5/2008 | Ophardt et al. | 222/181.3 |

FOREIGN PATENT DOCUMENTS

| | | |
|---|---|---|
| DE | 201 21 280 | 1/2003 |
| DE | 20 2004 003 671 | 8/2005 |

* cited by examiner

*Primary Examiner*—Frederick C. Nicolas
(74) *Attorney, Agent, or Firm*—Riches, McKenzie & Herbert LLP

(57) ABSTRACT

A liquid dispenser, particularly advantageous for low viscosity solutions, such as, alcohol solutions, for dispensing from an upper open end of a reservoir out an outlet at a height above the level of liquid in the reservoir onto a user's hand disposed below the reservoir, advantageously by actuation of an actuator below a lower end of the reservoir.

15 Claims, 9 Drawing Sheets

FLUID DISPENSER WITH SANITARY NOZZLE

SCOPE OF THE INVENTION

This invention relates to a fluid dispenser for dispensing fluid and, more particularly, to a dispenser in which an outlet nozzle is protected in a cabinet preferably against engagement by a user to avoid contamination.

BACKGROUND OF THE INVENTION

Liquid dispensers for soap and alcohol cleaning and disinfectant solutions are used in washrooms and hospital environments. A disadvantage with many liquid dispensers is that a user's hand may engage an outlet nozzle with potential contamination flow back from the nozzle to contaminate a dispensing mechanism and/or fluid reservoir.

Dispensers are known which dispense downwardly from a bottom outlet of a reservoir via a dispensing mechanism typically a pump having a one-way valve to prevent fluid flow outwardly when a dispensing mechanism is not being operated. Such dispensers suffer the disadvantage that when used with low viscosity solutions, such as alcohol, the one-way valve is prone to leaking leading to dripping and wastage.

SUMMARY OF THE INVENTION

To at least partially overcome these disadvantages, the present invention provides a liquid dispenser, particularly advantageous for low viscosity solutions, such as, alcohol solutions, for dispensing from an upper open end of a reservoir out an outlet at a height above the level of liquid in the reservoir onto a user's hand disposed below the reservoir, advantageously by actuation of an actuator below a lower end of the reservoir.

In one aspect, the present invention provides a fluid dispensing apparatus comprising: a cabinet defining an interior compartment with a discharge opening at its bottom, a fluid containing reservoir disposed within the compartment, the reservoir having an outlet opening at an upper end, a pump mechanism disposed within the compartment for activation to draw fluid from the reservoir upwardly through the outlet opening and to dispense it from a discharge outlet disposed within the compartment vertically above the discharge opening such that discharged fluid drops under gravity through an air gap within the compartment between the discharge outlet and the discharge opening, and an activation mechanism for activation of the pump mechanism by interaction with a user's body outside of the compartment.

In another aspect, the present invention provides a fluid dispensing apparatus comprising: a cabinet defining an interior compartment with a discharge opening at its bottom, a fluid containing reservoir within the compartment, the reservoir having an outlet opening at an upper end, a pump mechanism within the compartment for activation to draw fluid from the reservoir upwardly through the outlet opening and to dispense it via a discharge outlet downwardly through the discharge opening, the discharge outlet is open to atmosphere within the compartment at a height above a height of liquid in the reservoir, and an activation mechanism for activation of the pump mechanism by interaction with a user's body outside of the compartment.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
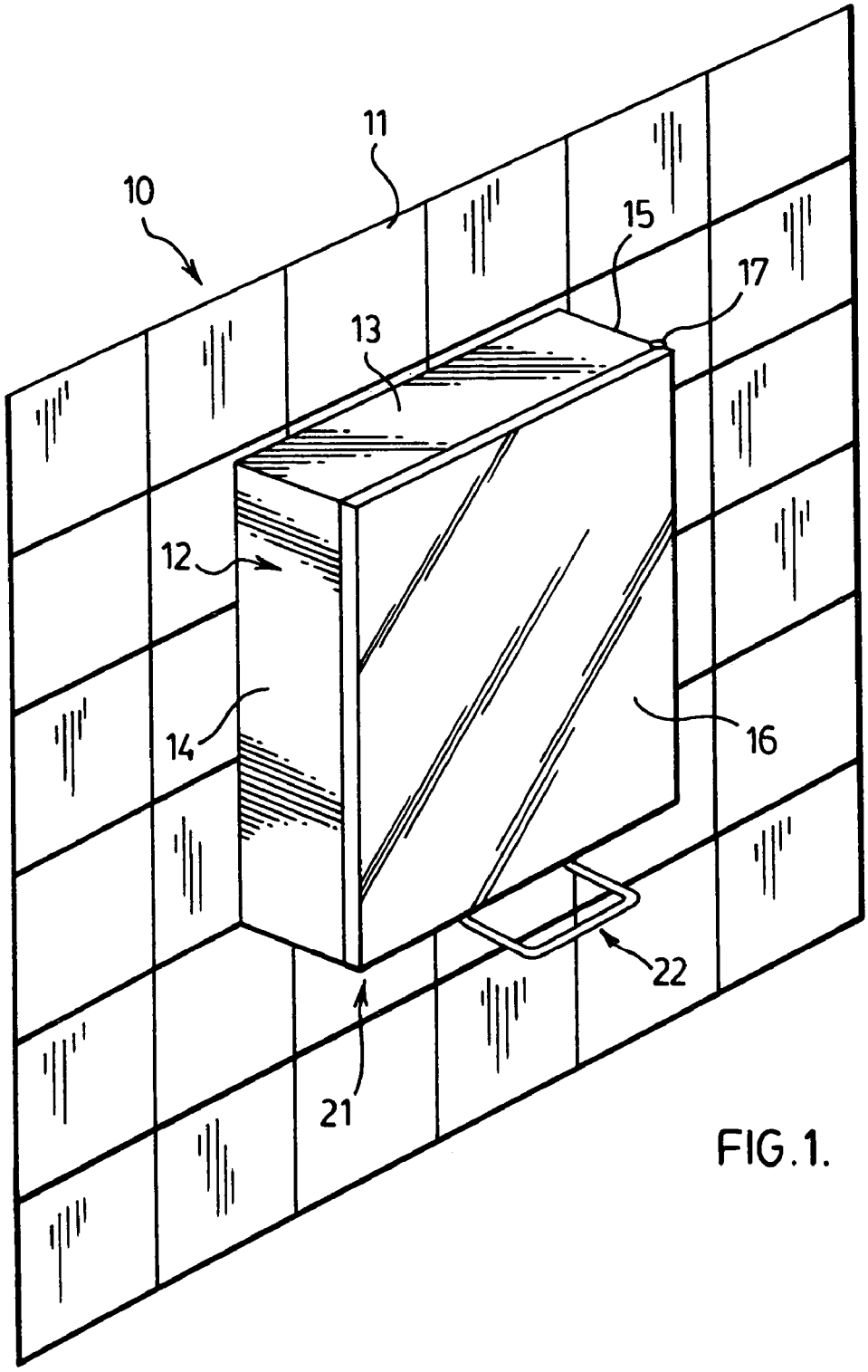
FIG. 1 is a perspective view of a wall mounted dispenser unit in accordance with a first embodiment of the present invention.
Figure 2:
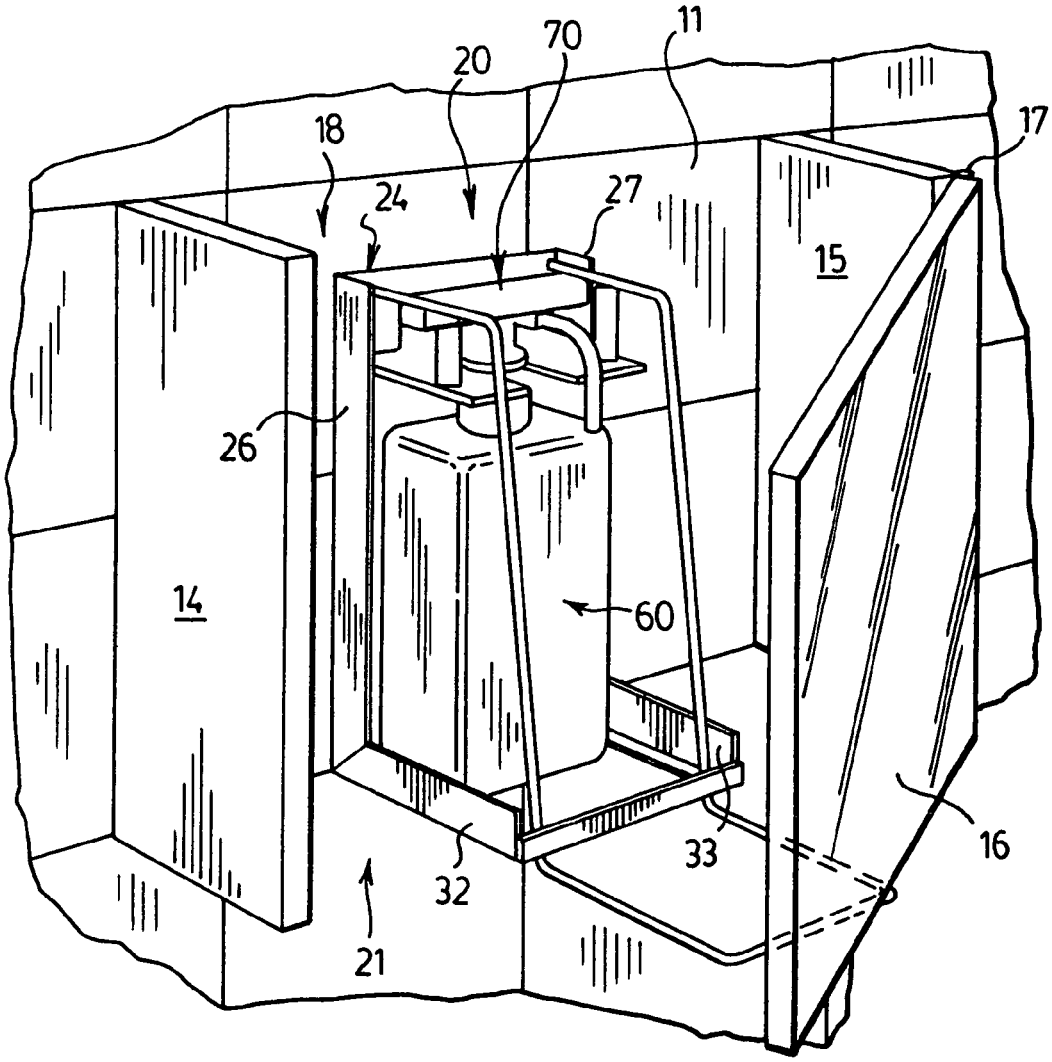
FIG. 2 is a schematic perspective view of the dispenser unit of FIG. 1 with its cabinet schematically illustrated as open and partially cross-sectional.

Reference is made to FIGS. 1 and 2 which illustrate a dispensing unit 10 mounted to a tile wall 11. The dispensing unit 10 includes a cabinet 12 which has a horizontal top wall 13 joining to vertical side walls 14 and 15 which extend downwardly therefrom. A mirrored door 16 is pivotally coupled by a hinge 17 to the side wall 15 for pivoting between a closed position as seen in FIG. 1 and an open position as seen in FIG. 2. The cabinet 12 provides an interior compartment 18 which is open at its bottom as a bottom opening 21 between the tile wall 11, the two side walls 14 and 15 and the mirrored door 16. The dispensing unit 10 further includes a dispenser 20 secured inside the compartment 18 within the cabinet 12 as, for example, by being secured to the tile wall 11. As seen having regard to FIGS. 1 and 2, the interior compartment is enclosed but for being open at the bottom opening 21. That is, the interior compartment is enclosed at its top by the top wall 13, at its back by the tile wall 11, at its sides by the side walls 14 and 15 but is open at its bottom at the bottom opening 21.

Claims 1 and 9 recite the limitation that of a pump mechanism disposed within the compartment to dispense fluid from a discharge outlet disposed within the compartment vertically above the discharge opening such that the discharge fluid drops under gravity through an air gap within the compartment between the discharge outlet and the discharge opening.

The dispenser 20 is adapted to be manually activated by a user urging an activation lever 22 inwardly towards the tile wall 11 so as to dispense fluid from the dispenser 20 out the bottom opening 21 and onto a hand of a user disposed underneath the cabinet 12 and below the dispenser 20.

Figure 6:
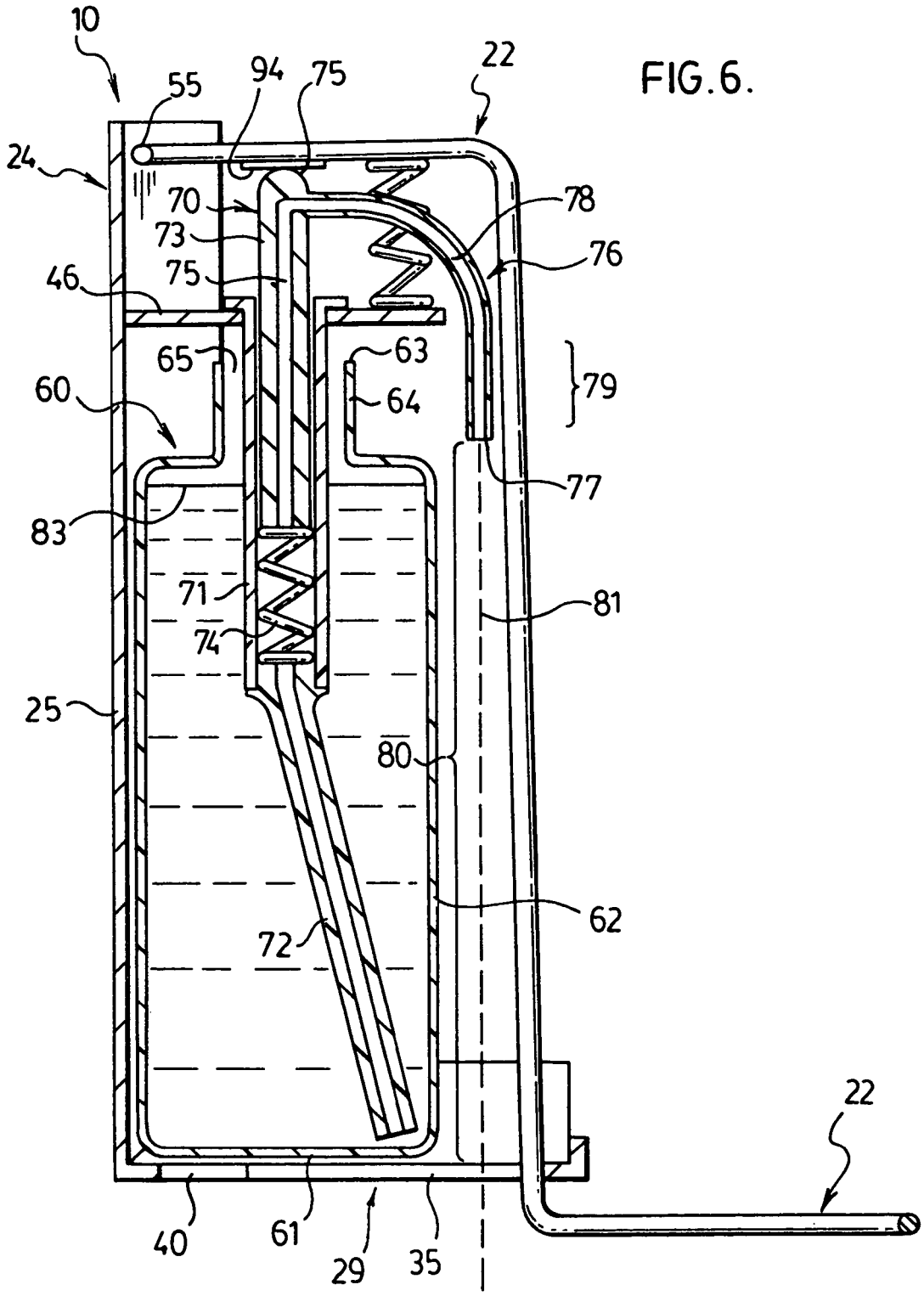
FIG. 6 is a schematic cross-sectional side view similar to that shown in FIG. 3 but also showing the bottle and pump mechanism.

FIGS. 2 and 6 best show the dispenser 20 as including the activation lever 22, a housing 24, a fluid containing reservoir bottle 60 and a pump mechanism 70.

Figure 4:
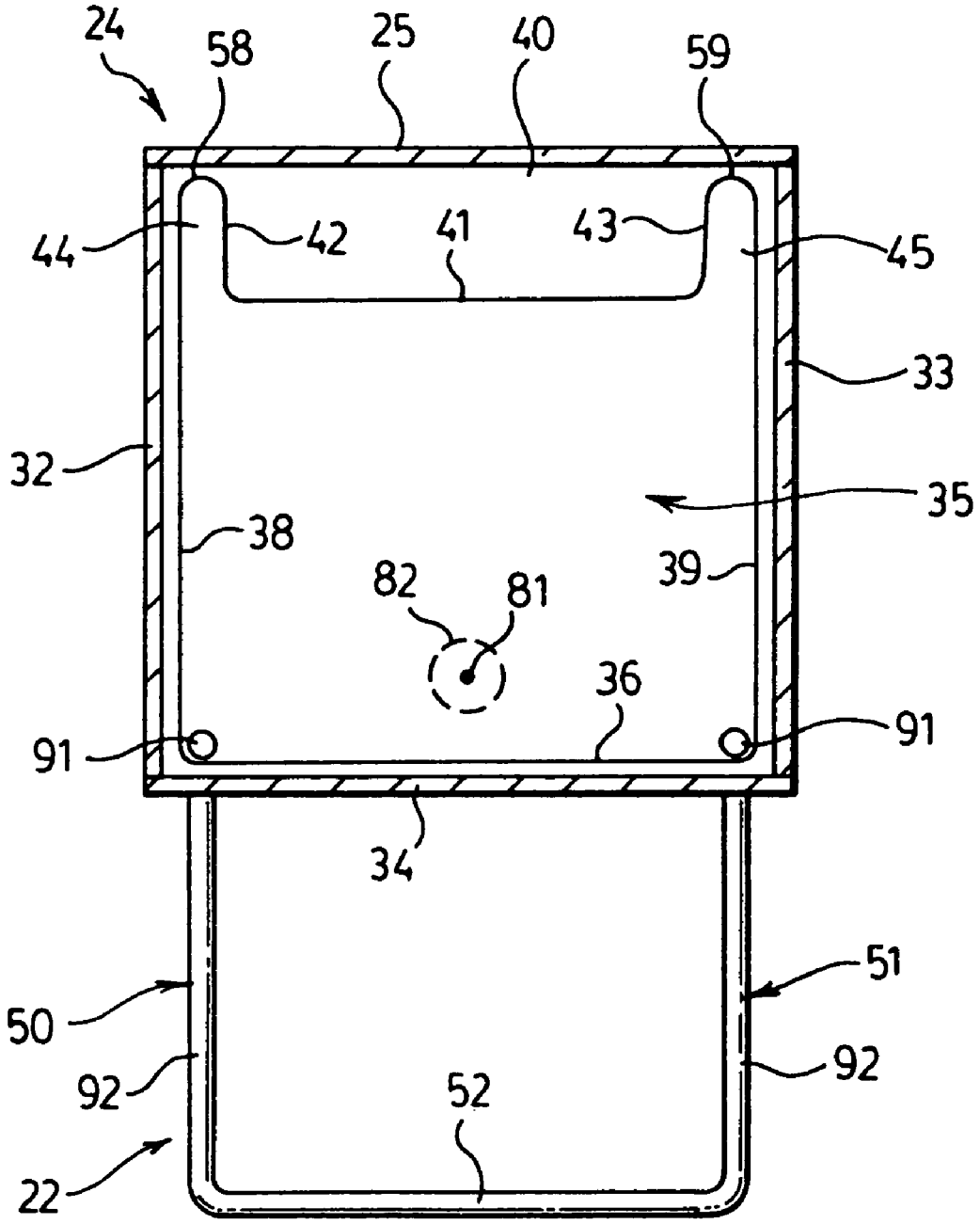
FIG. 4 is a cross-sectional plan view along section line 4-4' in FIG. 3.

The housing 24 has a vertical back plate 25 for securing to the tile wall 11. Back plate side flanges 26 and 27 extend along each side of the back plate 25 forwardly in a vertical plane. From a lower end 28 of the back plate 25, a guide plate 29 extends forwardly to a front end 30 of the guide plate 29. The guide plate 29 has side flanges 32 and 33 extending upwardly in a vertical plane on each side and joined at a mitred junction with the respective side flanges 26 and 27 to provide the side flanges 26 and 32 as a first L-shaped lateral support member on one side and the flanges 27 and 33 as a second L-shaped lateral support bracket member on a second side. The front end 30 of the guide plate 29 has a front wall 34 extending vertically upwardly. As best seen in FIG. 4, the guide plate 29 has a central opening 35 therethrough with a front edge 36 approximate the front wall 34 and side edges 38 and 39 approximate the side flanges 32 and 33. A central bottle support shelf 40 is provided as part of the guide plate 29. The support shelf 40 has a front edge 41 and two side edges 42 and 43. Between the side edge 38 of the central opening 35 and the side edge 42 of the shelf 40, a rearwardly extending blind channelway 44 is provided having a closed rear end 58. Similarly, between the side edge 39 of the central opening 35 and the side edge 43 of the shelf 40, a rearwardly extending blind channelway 44 is provided having a closed rear end 58. Housing 24 has a pump support plate 46 which extends forwardly from the back plate 25 between the side flanges 26 and 27 proximate the top of the back plate 25.

Figure 3:
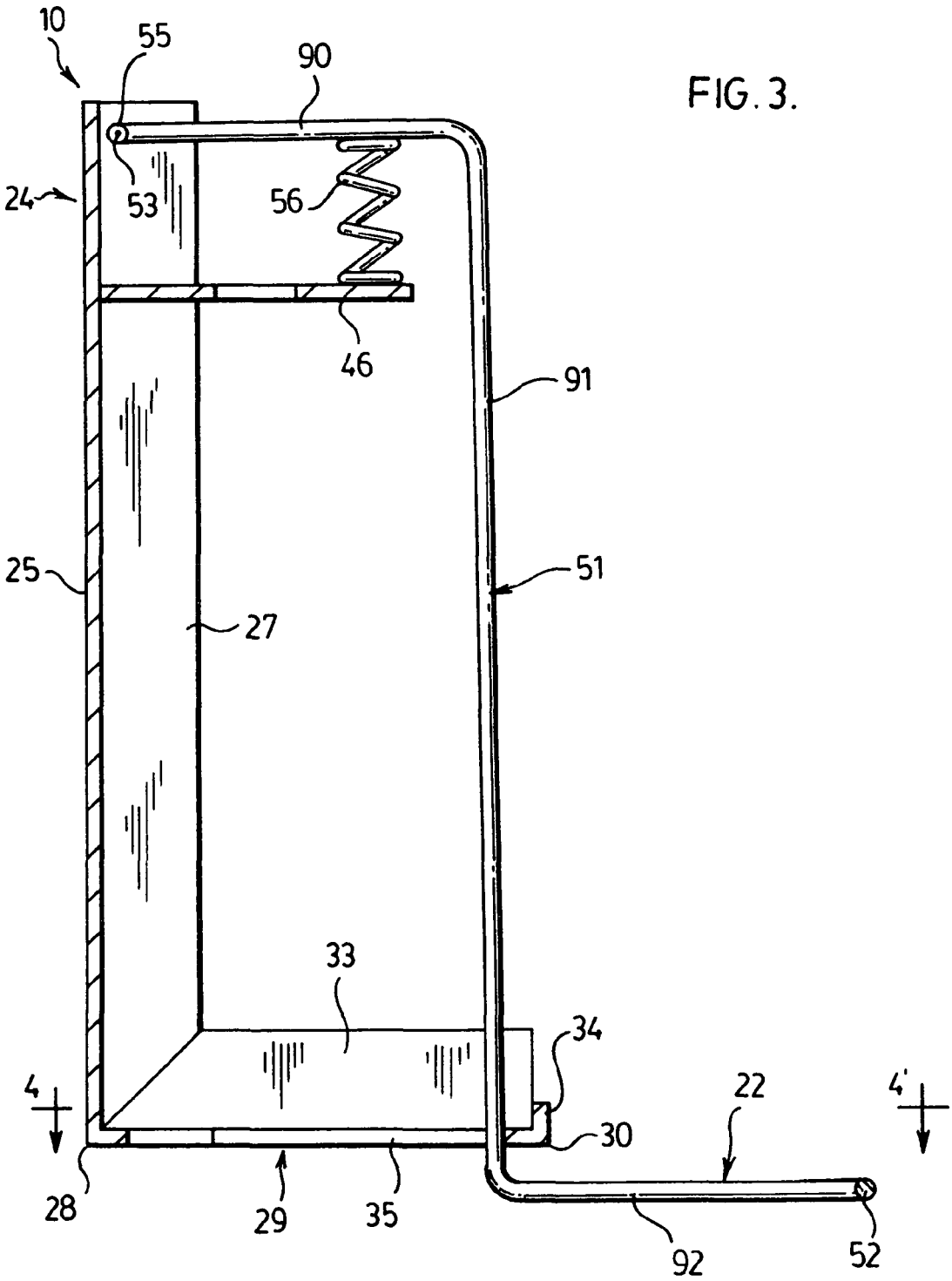
FIG. 3 is a schematic cross-sectional side view of the dispenser shown in FIG. 2 showing its housing and actuation lever with the bottle and pump mechanism removed.

The activation lever 22 comprises a continuous length of metal rod having two Z-shaped side portions 50 and 51 joined by a centre bridge portion 52. Each of the side portions 50 and 51 are pivotally coupled at their upper end 55 to the respective side flanges 26 and 27 for pivoting about the same horizontal axis 53. A spring member 56 is disposed between support plate 46 and the actuation lever 22 so as to bias the actuation lever 22 to pivot about the axis 53 counter-clockwise as seen in FIG. 3. The actuation lever 22 is received with its two side portions 50 and 51 extending through the central opening 35 of the guide plate 29 and extending forwardly therefrom to the front bridge member 52.

Figure 5:
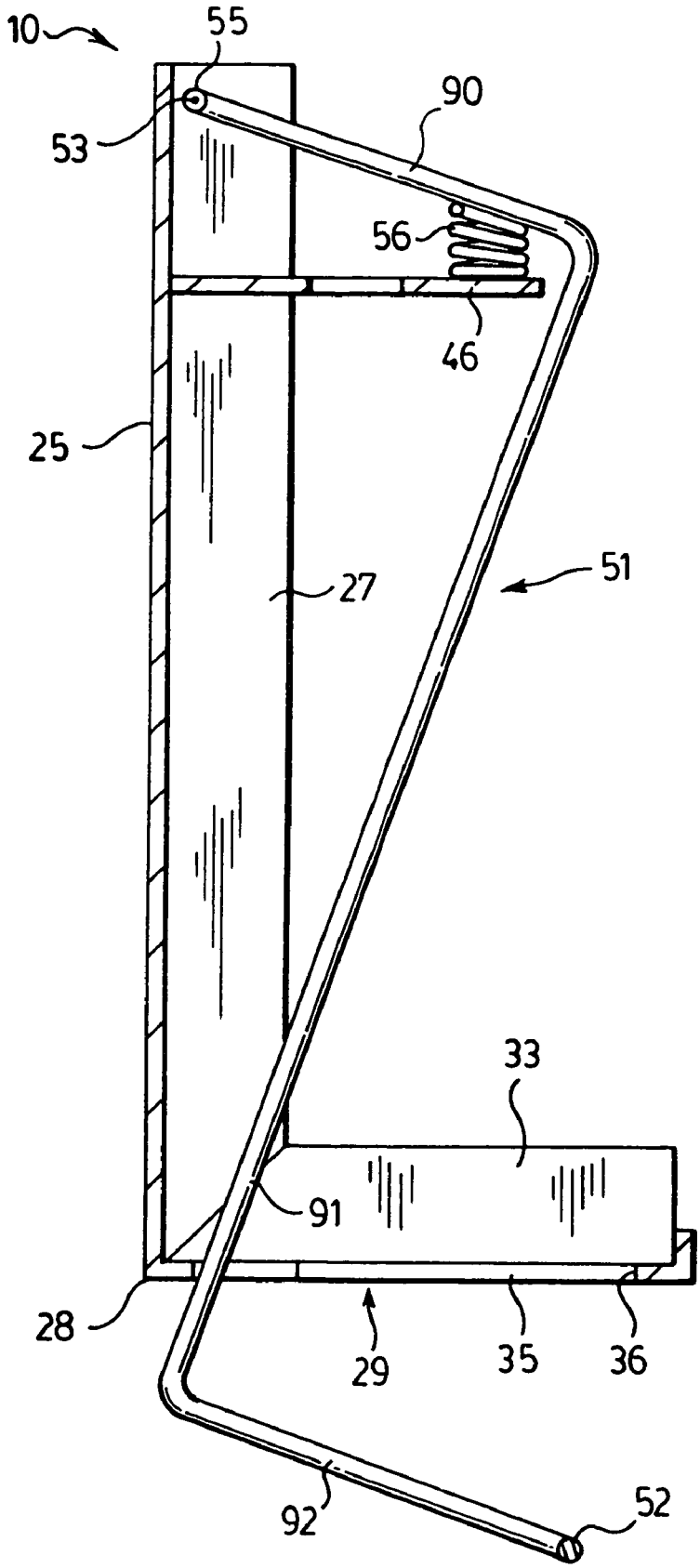
FIG. 5 is a side view the same as shown in FIG. 3 but with the actuation lever in a retracted position.

FIG. 3 illustrates an extended position in which the spring 56 has biased the actuation lever 22 as far counter-clockwise as possible with the side arm portions 50 and 51 engaging the front edge 36 of the central opening 35 through the guide plate 29. From the extended position of FIG. 3, a user may engage the bridge portion 52 of the activation lever 22 and move the activation lever 22 rearwardly against the bias of the spring 56 to a retracted position as illustrated in FIG. 5 in which the activation lever 22 has been pivoted about the axis 53 until the side portions 50 and 51 engage the rear of the central opening 35, and move particularly the blind rearward ends 58 and 59 of the channelways 44 and 45. On manual release of the activation lever 22 from the retracted position of FIG. 5, the spring 56 moves the activation lever 22 to the extended position as shown in FIG. 3. As is apparent in FIG. 4, the side arm portions 50 and 51 are spaced apart a distance such that their lateral outside surfaces are close to the lateral edges 38 and 39 of the central opening 35 to provide for sliding guidance of the side arm portions 50 and 51 as can assist in keeping the lower end of the activation lever 22 aligned relative to the axis 53. Each side portions 50 and 51 of the activation lever 22 has an upper arm section 90, a middle arm section 91 and a lower arm section 92. The upper arm section 90 extends from the upper end 55 forwardly in front of the bottle support shelf 40. The middle arm section 90 extends from bottle support above the shelf 40 to below guide plate 29. The lower arm section 92 extends from the lower end of the middle section 91 to the bridge portion 52.

Referring to FIG. 6, the bottle 60 is closed at a lower end 61 from which side wall 62 extend upwardly to an upper end 63 having upstanding neck 64 with an opening 65. The pump mechanism 70 is schematically illustrated as having a piston chamber forming tube 71 fixedly secured in an opening through the pump support plate 46 to extend downwardly and carrying a dip tube 72 extension fixedly secured in sealed relation and angled slightly forwardly. A piston member 73 is provided coaxially vertically slidably received within the piston chamber forming tube 71 and biased upwardly by an internal pump spring 74. An upper end 75 of the piston member 73 engages with the actuation lever 22 via a bridging bar 94 extending between the side arm portions 50 and 51 as seen in FIG. 6 such that the actuation lever 22 in movement from the extended to the retracted position will displace the piston member 73 axially into the piston chamber forming tube 71 against the bias of the pump spring 74 to displace fluid through a central axial discharge passageway 75 in the piston member 73 which connects to the hollow interior of a discharge tube 76 so as to discharge fluid from an outlet 77. As seen, the discharge tube 76 curves forwardly and downwardly in a relatively large radius curved tube portion 78 and then extends vertically downwardly as a straight tube portion 79 in front of the side wall 62 of the bottle 60. The outlet 77 is vertically disposed above a forward portion of the central opening 35 in the guide plate 29 centrally between the side flanges 32 and 33. In the preferred embodiment shown, the piston member 73 and outlet 77 together move upwardly and downwardly relative the pump support plate 46, however the discharge outlet 77 is maintained at the same position when seen in plan view and thus merely moves vertically upwardly and downwardly.

With movement of the activation lever 22, a dose amount of fluid is discharged from the outlet 77 preferably under substantially laminar flow conditions such that the discharged fluid flows under gravity vertically downwardly in the open air gap 80 between the outlet 77 and the guide plate 29 and exits the central opening 35 of the guide plate 29 without substantial dispersion of the fluid discharged relative a vertical axis 81 coaxial with the outlet 77 of the discharge tube 76, for example, as seen in FIGS. 4 and 6. Preferably, the fluid discharged will not expand or dissipate beyond the extent of a rotational circle indicated in stippled lines 82 as seen in FIG. 4. Preferred discharge of fluid from the outlet 77 is so as to extend downwardly relatively compactly about the axis 81. Preferably, the fluid passes through the discharge tube 76 and is discharged from the outlet 77 under laminar flow conditions, and with a minimum of turbulence. This may be achieved by adopting various features, such as, sizing the discharge tube 76 having regard to the volume of liquid discharged with time in a typical stroke and the viscosity of the fluid discharged so as to achieve sufficiently low velocity speeds for substantially laminar flow. This can be assisted by suitable selection of various factors, such as, selecting the shape and cross-section area of the outlet, preferably as circular, providing desired nozzling effect at the outlet as, for example, by having the discharge tube 76 immediately adjacent the outlet 77 discharge through a reduced diameter cylindrical nozzle, compared to the discharge tube 76, as a tight stream parallel the axis 81. Similarly, providing a relatively large radius to the discharge tube 76 over its curved tube portion 78 from the horizontal at the piston member 73 to the vertical straight tube portion 79 is advantageous as is providing the least some length of vertically extending straight tube portion 79 approximate the outlet 77.

Of course, the nature of the fluid to be dispensed, notably its viscosity and density needs to be considered and towards avoiding diffusion of the discharged fluid. To avoid dispersion of the discharged fluid, the use of relatively low viscosity fluids is preferred, such as those, for example, which comprises alcohol or alcohol solutions for disinfecting or cleaning as are used frequently in hospital environments and have a viscosity no greater than that of water.

As seen in FIG. 6, the outlet 77 of the discharge tube 76 is disposed at a height above a maximum height 83 of the level of liquid in the bottle. This is advantageous so as to avoid a siphoning effect. For example, if the outlet 77 of the discharge tube 76 were disposed below the liquid level 83 of the liquid in the bottle 60, a siphoning could develop under which liquid, particularly low viscosity liquid, such as, alcohol could under gravity pass through the dip tube 72 and pump mechanism 70 and out of the outlet 77.

The opening 65 of the bottle 60 is shown as disposed loosely about the piston member 73 and providing for communication between the atmosphere and the interior of the bottle. The bottle may readily be removed by the lower portion of the bottle being moved forwardly of the bottle support shelf 40 with the bottle 60 to pass through the central opening 35 of the guide plate 29 between the side portions 50 and 51 of the activation lever 22 and, hence, out through the bottom opening 21 of the cabinet 12 without the nee for the door 16 to be open or openable. The dip tube 72 is preferably tilted forwardly to assist in permitting the bottle 60 to be slid vertically and rearwardly on to and off of the dip tube 72. The bottle 60 when in use merely rests on the bottle support shelf 40 and may to some extent, tip forwardly, for example, until the neck 64 may engage on the piston member 73. The support shelf 40 could be independent of the guide plate 29.

Figure 7:
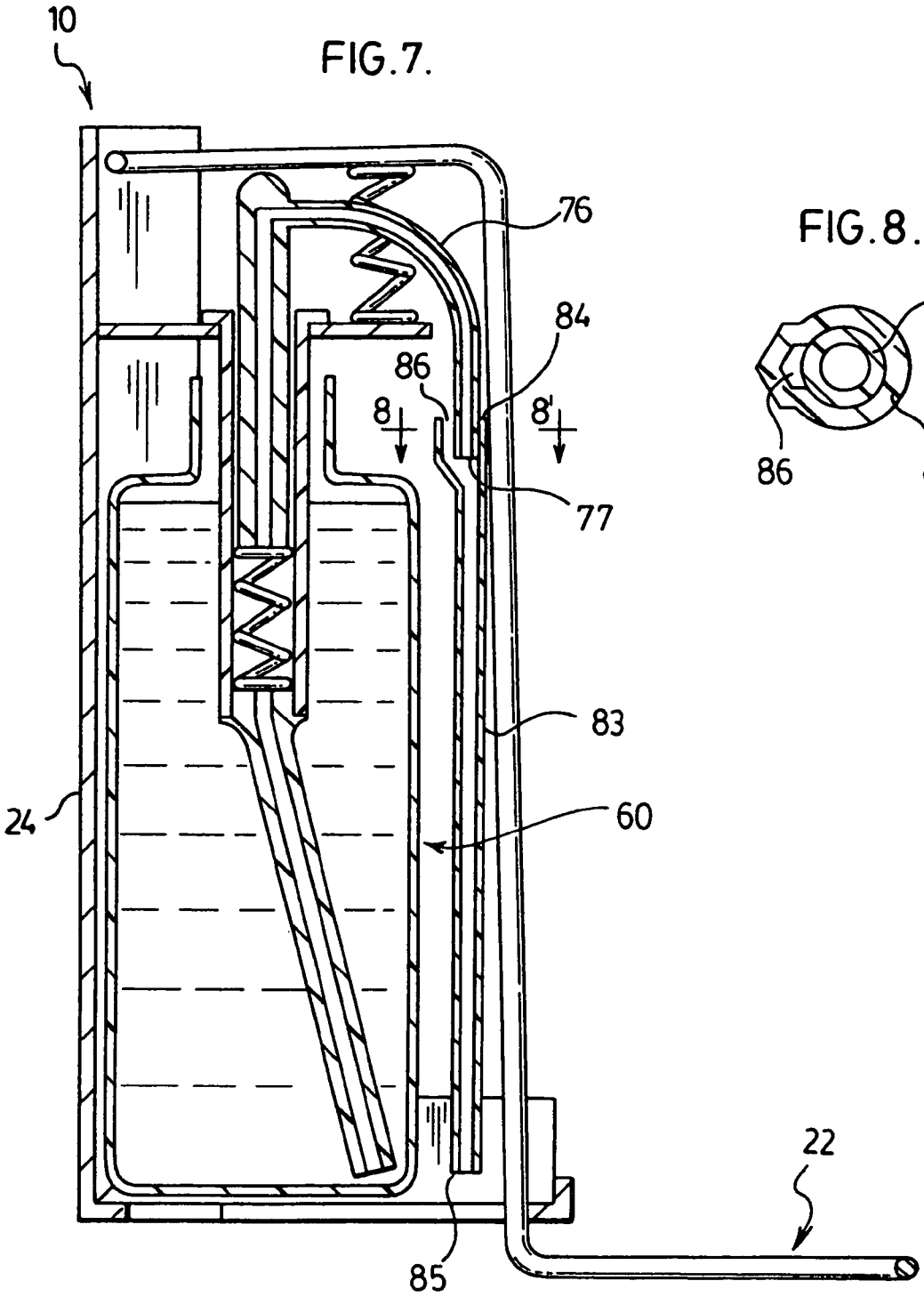
FIG. 7 is a cross-sectional side view the same as shown in FIG. 6 but of a second embodiment in accordance with the present invention incorporating a nozzle extension.
Figure 8:
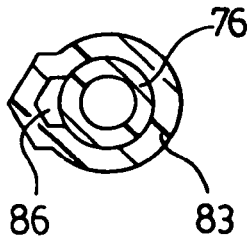
FIG. 8 is a cross-sectional plan view along section line 8-8' in FIG. 7.

Reference is made to FIG. 7 which shows a second embodiment of the invention in accordance with the present invention. The embodiment of FIG. 7 is identical to the embodiment of FIG. 6 with the exception that an extension tube 83 is secured to the discharge tube 76 with a first upper end 84 of the extension tube 83 secured about the outlet 77 of the discharge tube 76 and a second lower end 85 of the extension tube 83 disposed at a height therebelow approximate the guide plate 29. As seen in FIG. 7 and in cross-section in FIG. 8, a siphon-breaking passageway 86 is provided open to atmosphere from the upper end 84 of the extension tube 83 and extending to below the outlet 77 to avoid creating a siphon which might siphon liquid from the bottle 60 out the lower end 85 of the extension tube 83. The extension tube 83 is preferably fixedly secured to the discharge tube 76 and will move vertically with the discharge tube 76. In the embodiment of FIG. 7, fluid dispensed from the outlet 77, whether or not under laminate flow conditions, will pass through the extension tube 83 and out its lower end 85 to drop onto a hand of a user. The bypass or siphon-breaking passageway 86 also assists to ensure that fluid disposed within the extension tube 83 will under gravity more readily flow down through the extension tube 83.

Figure 9:
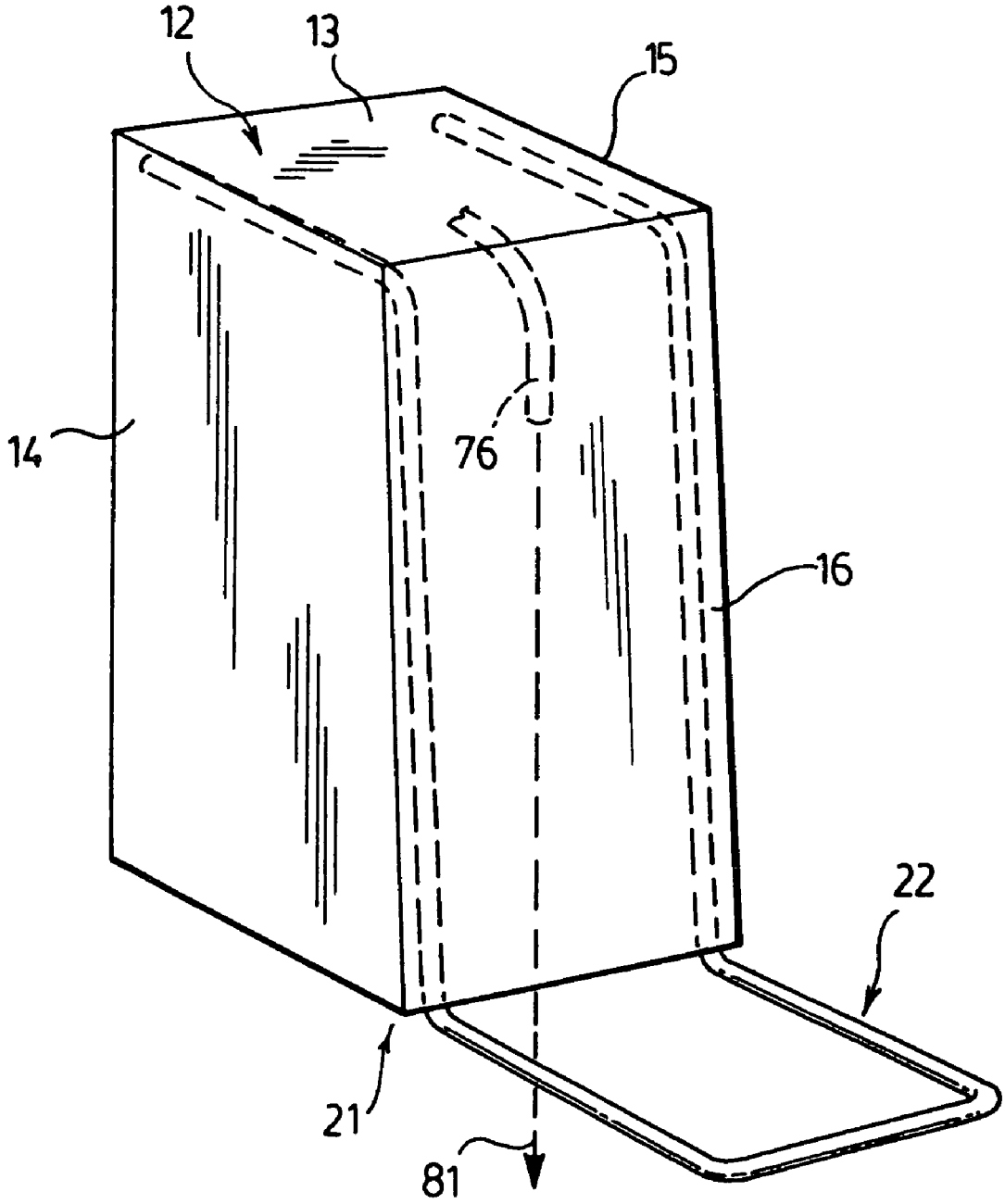
FIG. 9 is a pictorial view of a dispenser unit in accordance with a third embodiment of the present invention.

The particular nature of the cabinet 12 is not limited. Reference is made to FIG. 9 which shows a third embodiment which has a dispenser 20 identical to that in the first embodiment of FIGS. 1 to 6 but in which the cabinet 12 and the activation lever 22 extending from the bottom of the cabinet closely overlies the housing 24.

Figure 10:
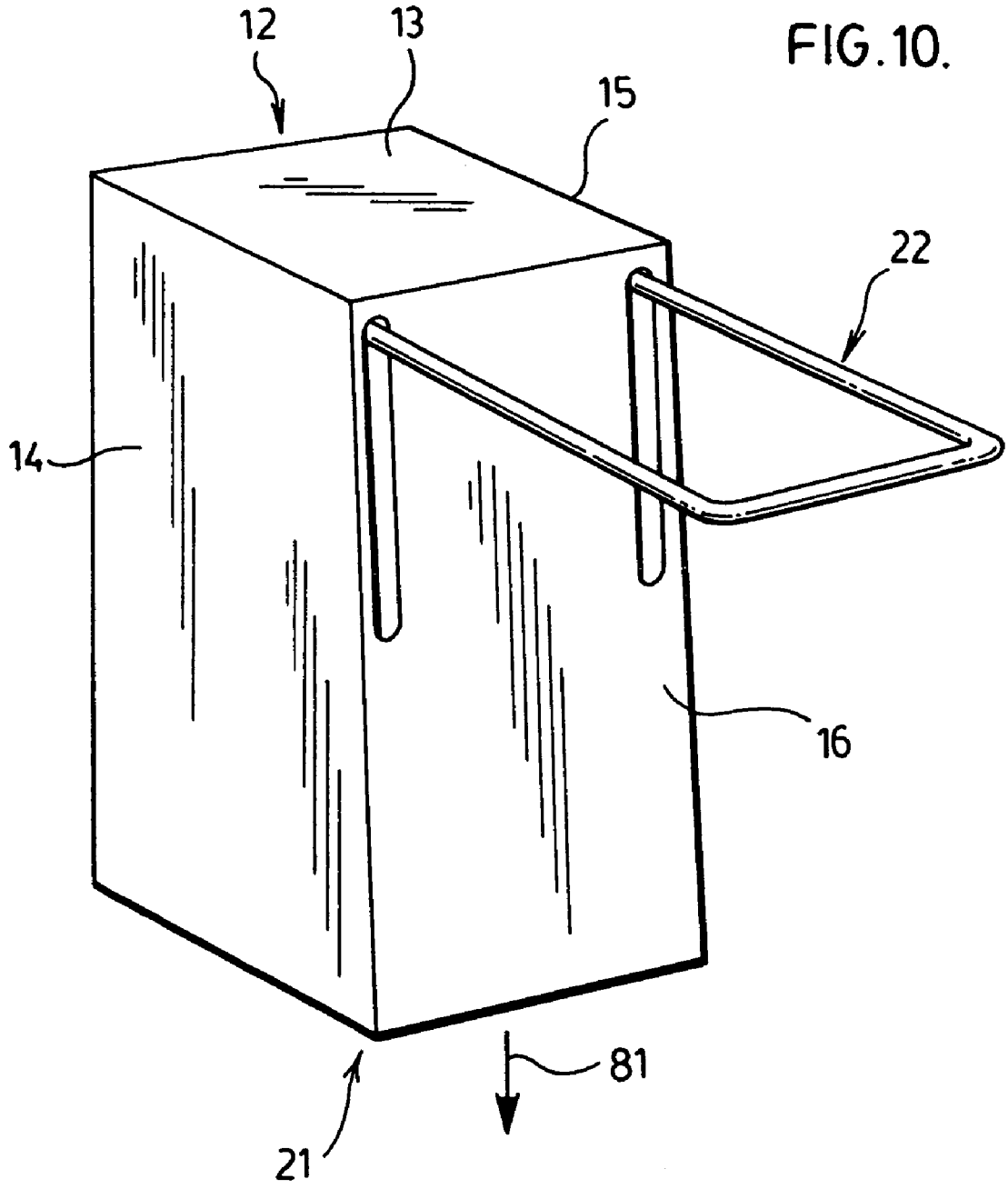
FIG. 10 is a pictorial view of a dispenser unit in accordance with a fourth embodiment of the present invention.

FIG. 10 illustrates a fourth embodiment of the invention which is identical to the third embodiment of FIG. 7 with the exception that the activation lever 22 extends through a front face 16 of the cabinet 12 near the top 13 of the cabinet. Dispensing continues to be, as in the case of the first embodiment, out the bottom of the housing. The various embodiments shown could be adapted for automated dispensing by providing an electric pump to dispense fluid as activated by an activation switch, such as, a pressure activated switch visibly carried on the cabinet or a hand sensing switch disposed, for example, on the cabinet to sense a user's hand underneath the cabinet vertically below the outlet 77.

The preferred embodiment has been illustrated with a pump mechanism which is fixedly secured to the support plate and not to the bottle. It is appreciated that may other removable and non-removable bottles and pumping mechanisms may be provided including those in which the pump mechanism is fixedly secured to the bottle. The particular nature of the pump mechanism 70 formed by the piston chamber forming tube 71 and the piston member 73 is not essential and many different pump mechanisms may be adopted as known to persons skilled in the art.

The preferred embodiment of FIG. 1 illustrates the cabinet having a hinged door 16. This is not necessary however illustrates one preferred embodiment in which the dispenser unit 10 in accordance with the present embodiment is adapted for use. While not shown, the cabinet 12 may also include within its compartment 18 various shelves for storage of various devices including replacement bottles 60 containing fluid. The upper neck 64 of the bottles 60 may be threaded as, for example, to assist in storage in a sealed manner before use as with a removable threaded cap.

While the invention has been described with reference to preferred embodiments, many modifications and variations will now occur to persons skilled in the art. For a definition of the invention, reference is made to the following claims.

The invention claimed is:

1. A fluid dispensing apparatus comprising:

a cabinet defining an interior compartment which is enclosed at its top, front, back and sides and is open at its bottom at a discharge opening, a fluid containing reservoir disposed within the compartment, the reservoir having an outlet opening at an upper end, a pump mechanism disposed within the compartment for activation to draw fluid from the reservoir upwardly through the outlet opening and to dispense the fluid from a discharge outlet disposed within the compartment vertically above the discharge opening such that discharged fluid drops under gravity through an air gap within the compartment between the discharge outlet and the discharge opening, an activation mechanism for activation of the pump mechanism by interaction with a user's body outside of the compartment wherein the activation mechanism is a lever pivotably mounted within the compartment for activation of the pump mechanism, the lever extending to outside of the compartment where it presents an engagement portion for manual engagement by a user to pivot the lever.

2. A fluid dispensing apparatus as claimed in claim 1 wherein the activation mechanism permits manual engagement of a portion of the activation mechanism outside of the compartment.

3. A fluid dispensing apparatus as claimed in claim 1 wherein the discharge outlet is open to atmosphere within the compartment at a height above a height of liquid in the reservoir.

4. A fluid dispensing apparatus as claimed in claim 1 wherein the fluid is discharged from the discharge outlet under substantially laminar flow conditions.

5. A fluid dispensing apparatus as claimed in claim 3 wherein the fluid is selected from the group consisting of a fluid comprising alcohol, a liquid comprising an alcohol solution, and a fluid having a viscosity not greater than pure water.

6. A fluid dispensing apparatus as claimed in claim 1 wherein the lever extending to outside of the compartment through the discharge opening.

7. A fluid dispensing apparatus comprising:

a cabinet defining an interior compartment with a discharge opening at its bottom, a fluid containing reservoir disposed within the compartment, the reservoir having an outlet opening at an upper end, a pump mechanism disposed within the compartment for activation to draw fluid from the reservoir upwardly through the outlet opening and to dispense the fluid from a discharge outlet disposed within the compartment vertically above the discharge opening such that discharged fluid drops under gravity through an air gap within the compartment between the discharge outlet and the discharge opening, an activation mechanism for activation of the pump mechanism by interaction with a user's body outside of the compartment, wherein the discharge outlet is open to atmosphere within the compartment at a height above a height of liquid in the reservoir, wherein the activation mechanism is a lever pivotably mounted within the compartment for activation of the pump mechanism, the lever extending to outside of the compartment where it presents an engagement portion for manual engagement by a user to pivot the lever, and wherein the lever extending to outside of the compartment through the discharge opening.

8. A fluid dispensing apparatus as claimed in claim 7 wherein the engagement portion of the lever extends below the cabinet.

9. A fluid dispensing apparatus comprising:

a cabinet defining an interior compartment which is enclosed but for being open at a discharge opening at its bottom, a fluid containing reservoir within the compartment, the reservoir having an outlet opening at an upper end, a pump mechanism within the compartment for activation to draw fluid from the reservoir upwardly through the outlet opening and to dispense the fluid via a discharge outlet downwardly through the discharge opening, the discharge outlet is open to atmosphere within the compartment at a height above a height of liquid in the reservoir, an activation mechanism for activation of the pump mechanism by interaction with a user's body outside of the compartment wherein the activation mechanism is a lever pivotably mounted within the compartment for activation of the pump mechanism, the lever extending to outside of the compartment where it presents an engagement portion for manual engagement by a user to pivot the lever.

10. A fluid dispensing apparatus as claimed in claim 9 wherein the activation mechanism permits manual engagement of a portion of the activation mechanism outside of the compartment.

11. A fluid dispensing apparatus as claimed in claim 9 wherein the lever extending to outside of the compartment through the discharge opening.

12. A fluid dispensing apparatus as claimed in claim 11 wherein the engagement portion of the lever extends below the cabinet.

13. A fluid dispensing apparatus as claimed in claim 9 wherein the fluid is discharged from the discharge outlet under substantially laminar flow conditions.

14. A fluid dispensing apparatus as claimed in claim 9 wherein the fluid is selected from the group consisting of a fluid comprising alcohol, a liquid comprising an alcohol solution, and a fluid having a viscosity not greater than pure water.

15. A fluid dispensing apparatus as claimed in claim 13 wherein the fluid is selected from the group consisting of a fluid comprising alcohol, a liquid comprising an alcohol solution, and a fluid having a viscosity not greater than pure water.

* * * * *